US011596245B1

(12) United States Patent
Cheng et al.

(10) Patent No.: US 11,596,245 B1
(45) Date of Patent: Mar. 7, 2023

(54) GLASSES DISPLAY STAND CAPABLE OF BEING ASSEMBLED IN MULTIPLE WAYS

(71) Applicants: Yung-Ching Cheng, Tainan (TW); Yung-Ming Cheng, Tainan (TW)

(72) Inventors: Yung-Ching Cheng, Tainan (TW); Yung-Ming Cheng, Tainan (TW)

( * ) Notice: Subject to any disclaimer, the term of this patent is extended or adjusted under 35 U.S.C. 154(b) by 0 days.

(21) Appl. No.: 17/502,416

(22) Filed: Oct. 15, 2021

(51) Int. Cl.
*A47F 7/02* (2006.01)
*A47F 5/10* (2006.01)

(52) U.S. Cl.
CPC ..... *A47F 7/021* (2013.01); *A47F 5/10* (2013.01)

(58) Field of Classification Search
CPC ..... A47F 7/021; A47F 5/10; A47F 7/0243; A47F 2005/0075; A47F 5/105; Y10S 248/902; A47B 43/00; A47B 87/02; A47B 87/0207; A47B 47/0091
USPC ..... 211/85.1, 169, 163, 165, 194, 195; 248/902, 346.03, 346.5, 163.1, 223.41, 248/225.11; 206/5
See application file for complete search history.

(56) References Cited

U.S. PATENT DOCUMENTS 2,808,941 A * 10/1957 Foster ..... A47F 5/02 211/163
2,936,897 A * 5/1960 Bloch ..... A47F 5/02 248/902
3,040,881 A * 6/1962 McNeill ..... A47F 7/021 206/5
3,333,708 A * 8/1967 Leblanc ..... A47F 7/021 211/72
3,333,709 A * 8/1967 Leblanc ..... A47F 7/021 211/144
3,351,208 A * 11/1967 Siegel ..... A47F 7/021 248/902
3,352,425 A * 11/1967 Burke ..... A47F 7/021 434/367
3,884,357 A * 5/1975 Bloch ..... A47F 7/021 211/163
3,891,092 A * 6/1975 Surrette ..... A47F 7/021 211/163
3,955,681 A * 5/1976 DeZinno ..... A47B 87/0223 206/821
4,126,366 A * 11/1978 Handler ..... B25H 3/00 211/163

(Continued)

FOREIGN PATENT DOCUMENTS

TW M608703 U 3/2021

*Primary Examiner* — Jennifer E. Novosad
(74) *Attorney, Agent, or Firm* — Rosenberg, Klein & Lee

(57) ABSTRACT

A glasses display stand includes support plates and leaning pieces and is capable of being assembled in multiple ways. At least one through hole with a locking hole is located on a middle part of each support plate. A plurality of connecting segments are arranged at each of two sides of each support plate and each having a mounting hole. At least one insertion segment and insertion hole are projecting from two sides of each support plate correspondingly for connection with another support plate. Each leaning piece includes at least one locking portion inserted through and locked in a corresponding locking hole, a leaning and mounting portion extending from an outer end of the locking portion, and a plurality of extension portions projecting from the leaning piece and corresponding to the connecting segments. A positioning hook is formed on a distal end of the extension portion.

10 Claims, 8 Drawing Sheets

(56) References Cited

U.S. PATENT DOCUMENTS 4,157,760 A * 6/1979 Wilson ..... A47F 7/021 211/163
4,211,331 A * 7/1980 Salmon ..... A47F 5/02 211/163
D262,754 S * 1/1982 Merl ..... D6/680.2
4,586,619 A * 5/1986 Eckert ..... A47F 7/021 248/902
4,609,975 A * 9/1986 Badolato ..... A47F 7/021 362/125
4,614,272 A * 9/1986 Shelton ..... A47F 7/021 211/163
4,718,561 A * 1/1988 Eckert ..... A47F 7/021 248/902
4,723,666 A * 2/1988 Nichols ..... A47F 5/08 248/902
5,025,931 A * 6/1991 Berger ..... A47F 7/021 248/176.1
D328,538 S * 8/1992 Berger ..... D6/682.4
5,226,548 A * 7/1993 Koeppel ..... A47F 5/02 211/144
5,257,703 A * 11/1993 Ascik ..... A47F 5/02 211/208
5,267,656 A * 12/1993 Nichols ..... A47F 5/04 211/163
D343,082 S * 1/1994 Sayad ..... D6/682.1
5,794,782 A * 8/1998 Ascik ..... A47F 11/04 206/730
5,853,090 A * 12/1998 Brozak, Jr. ..... A47F 5/02 211/13.1
5,974,707 A * 11/1999 Kowalczyk ..... G09F 1/14 40/124.4
6,036,311 A * 3/2000 Friedman ..... A47F 7/021 351/158
D426,984 S * 6/2000 Griffith ..... D6/680.2
D436,265 S * 1/2001 Kidd ..... D6/680.2
6,378,707 B1 * 4/2002 Taggert ..... A47B 65/00 211/186
6,443,317 B1 * 9/2002 Brozak, Jr. ..... A47F 7/021 211/85.1
7,040,495 B2 * 5/2006 Ascik ..... A47F 7/021 211/189
D605,427 S * 12/2009 Brooks ..... D6/680.2
D605,428 S * 12/2009 Brooks ..... D6/680.2
8,272,618 B2 * 9/2012 Kilwin ..... F16B 11/006 248/346.06
8,342,343 B2 * 1/2013 Shea ..... A47F 5/0018 211/163
8,636,152 B1 * 1/2014 Weigand ..... A47F 7/146 211/150
8,739,432 B2 * 6/2014 Rydinsky ..... D06F 59/02 248/164
8,833,571 B2 * 9/2014 Anderson ..... A47F 7/021 211/126.14
11,229,307 B1 * 1/2022 Conrad ..... A47B 96/02
2002/0000417 A1 * 1/2002 Kidd ..... A47F 7/021 211/163
2004/0007551 A1 * 1/2004 Ascik ..... A47F 3/004 211/163
2012/0205332 A1 * 8/2012 Anderson ..... A47F 7/021 211/85.1
2016/0138627 A1 * 5/2016 Bellido Jose ..... E04C 2/38 428/100
2016/0249753 A1 * 9/2016 Waksul ..... A47F 7/0064 211/41.2
2016/0374309 A1 * 12/2016 Weingart ..... A01K 1/034 248/346.06

* cited by examiner

GLASSES DISPLAY STAND CAPABLE OF BEING ASSEMBLED IN MULTIPLE WAYS

BACKGROUND OF THE INVENTION

Field of the Invention

The present invention relates to a glasses display stand, especially to a glasses display stand capable of being assembled in multiple ways to form different styles in order to meet diverse requirements. The assembly is fast and the glasses display stand is more convenient to use.

Description of Related Art

Glasses are usually placed on various types of display stands for sale in stores. However, most of the glasses display stands are in a certain style, unable to be adjusted according to different states and display space in use. Thereby such glasses display stand is not convenient to use.

Refer to Taiwanese Pat. No. M608703U "multifunctional spectacles display stand" published on Mar. 1, 2021, a glasses display stand revealed mainly includes a support piece and at least one mounting piece. At least one through hole is formed on a middle of the support piece while a plurality of support extension portions is projecting from each of two sides of the support piece and an insertion hole is formed on a rear end of the respective support extension portions. A mounting portion is projecting from one end of the mounting piece and capable of being mounted in and connected to the through hole of the support piece while a plurality of mounting extension portions corresponding to the support extension portions of the support piece is extending and projecting from a front end of the mounting piece. A hook is formed on a front end of the mounting extension portion.

Thus there is room for improvement and there is a need to provide a novel glasses display stand which is more convenient to use.

SUMMARY OF THE INVENTION

Therefore, it is a primary object of the present invention to provide a glasses display stand capable of being assembled in multiple ways to form different styles in order to meet various requirements of users. Moreover, the assembly of the glasses display stand is fast and the glasses display stand is more convenient to use.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
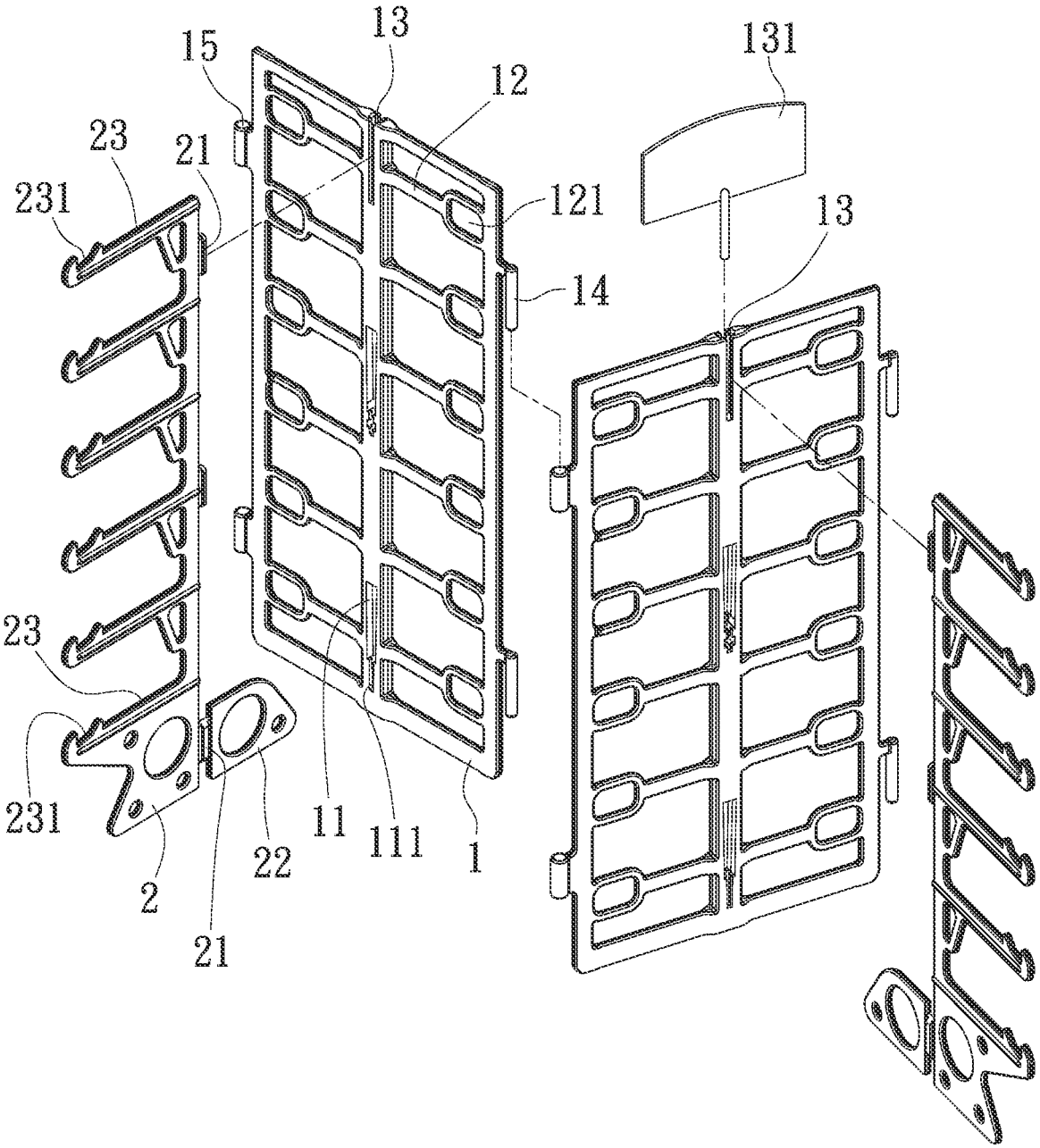
FIG. 1 is an exploded view of an embodiment according to the present invention.

In order to learn technical content, purposes and functions of the present invention more clearly and completely, please refer to the following detailed descriptions, figures and reference signs.

A glasses display stand according to the present invention mainly includes a plurality of support plates 1 and a plurality of leaning pieces 2.

The support plate 1 consists of at least one through hole 11 located on a middle part thereof, a plurality of connecting segments 12 arranged at each of two sides thereof to be in pairs horizontally, an insertion slot 13 formed on a top thereof, at least one insertion segment 14, and at least one insertion hole 15. At least one locking hole 111 is communicating with a bottom of the through hole 11 while an outer end of each of the connecting segments 12 is provided with a mounting hole 121 and a display board 131 is inserted into the insertion slot 13 for showing brands, advertising slogans, etc. The insertion segment 14 and the insertion hole 15 are corresponding to each other and projecting from two sides of the support plate 1.

The leaning piece 2 is arranged corresponding to the support plate 1. At least one locking portion 21 corresponding to the through hole 11 of the support plate 1 is projecting from one end of the leaning piece 2 and capable of being inserted through the through hole 11 and moved downward to be locked and positioned in the locking hole 111 which is 22 is extending from an outer end of the locking portion 21 of the leaning piece 2 at the lowest position while a plurality of extension portions 23 is extending and projecting from another end of the leaning piece 2, opposite to the end with the locking portion 21, and corresponding to the respective pairs of the connecting segments 12 of the support plate 1. A positioning hook 231 is formed on a distal end of the extension portion 23.

Figure 2:
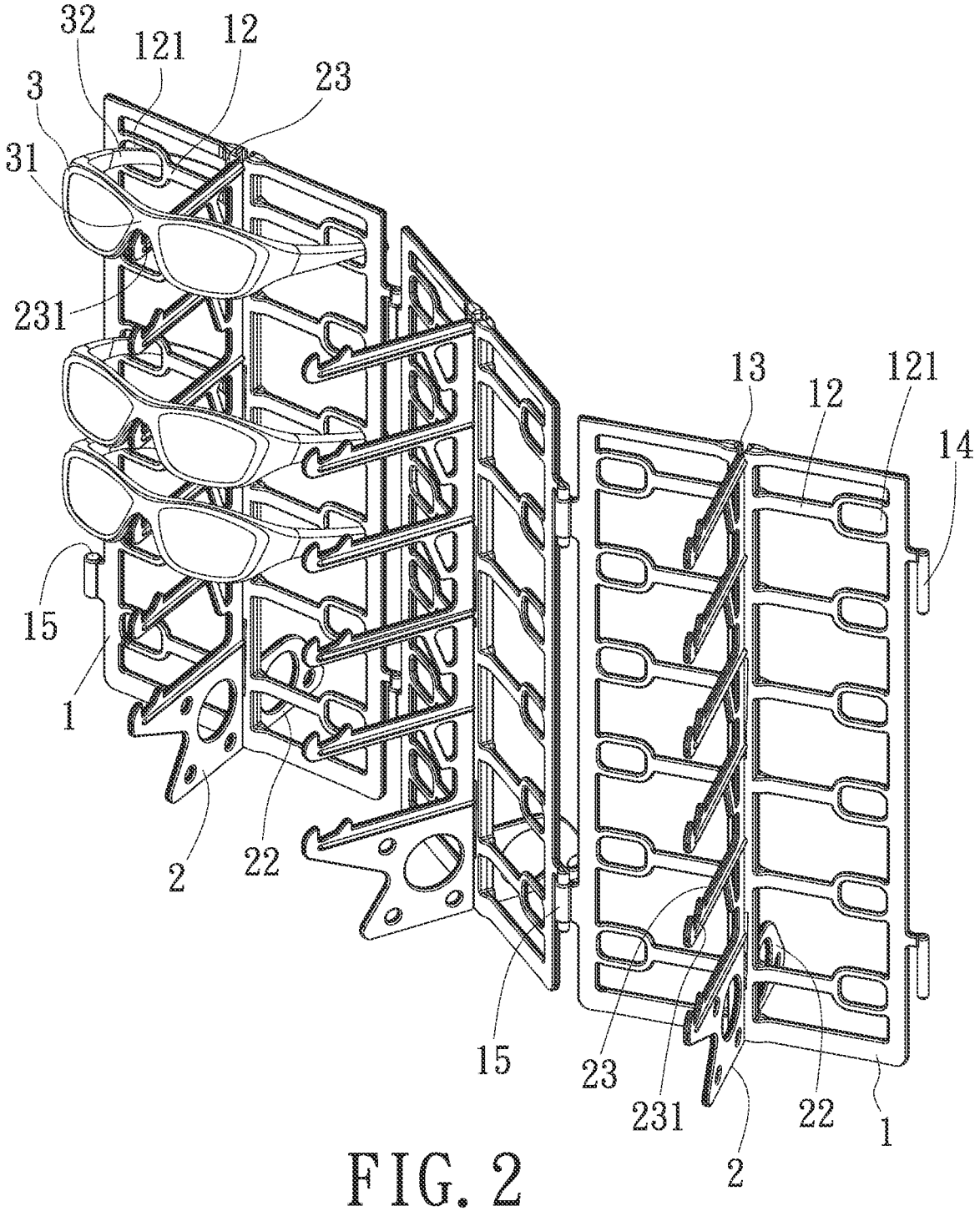
FIG. 2 is a perspective view of an embodiment in use according to the present invention.
Figure 3:
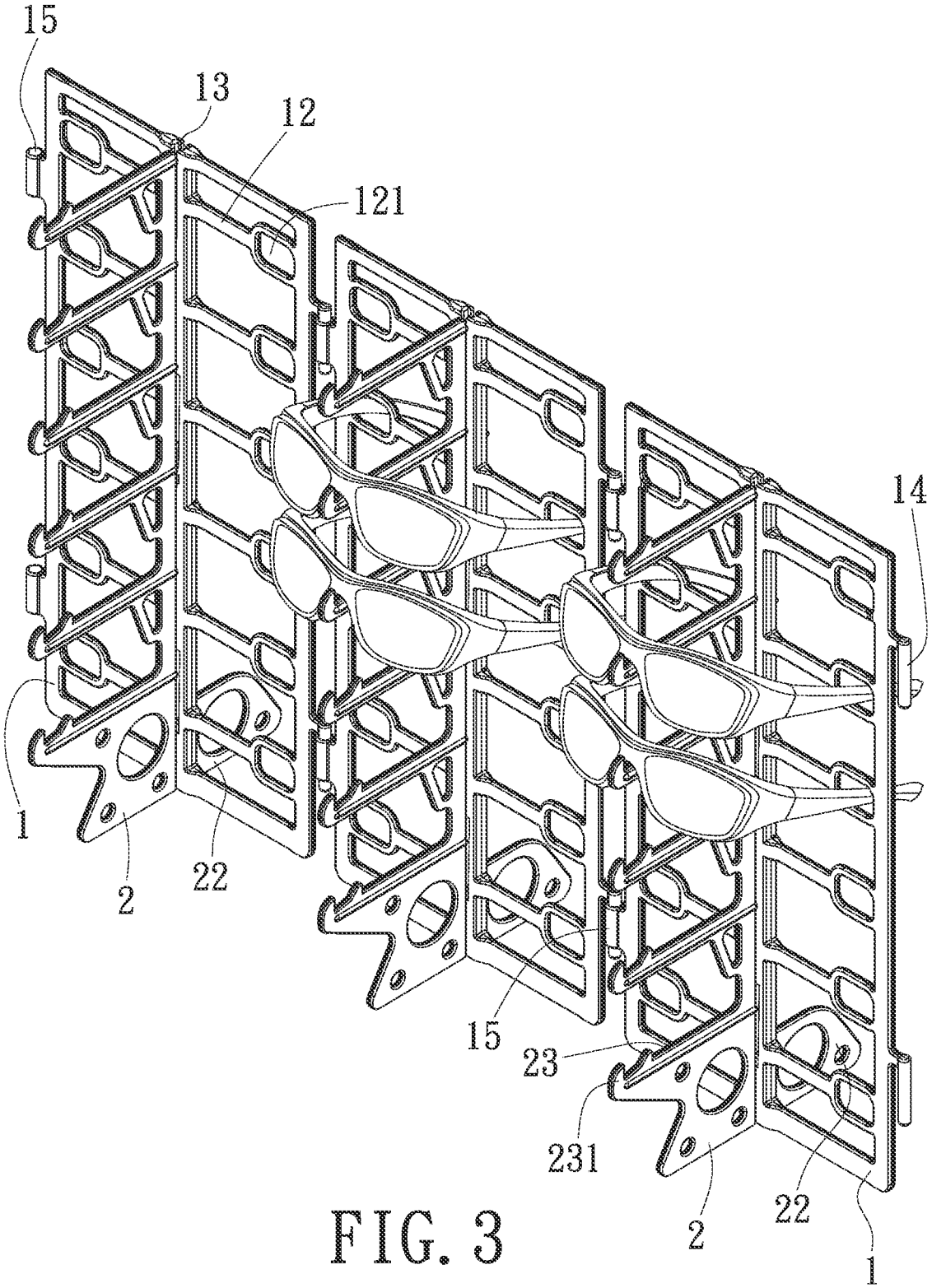
FIG. 3 is another perspective view of an embodiment in use according to the present invention.
Figure 4:
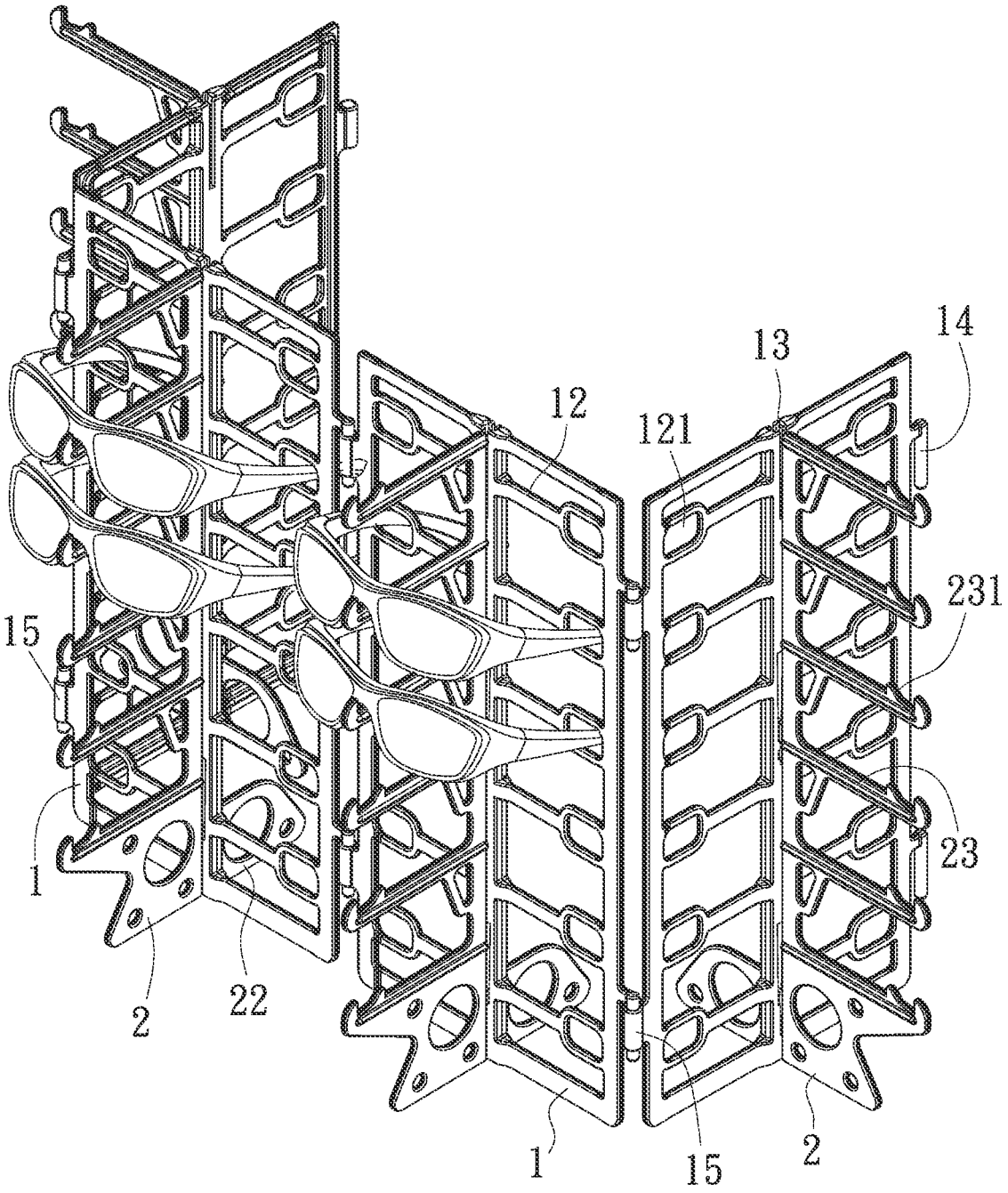
FIG. 4 is a further perspective view of an embodiment in use according to the present invention.

Also refer to FIG. 2, FIG. 3, and FIG. 4, while in use, the locking portion 21 of the leaning piece 2 is firstly inserted through the through hole 11 of the support plate 1 and then the leaning piece 2 is moved downward to allow the locking portion 21 being locked and positioned in the locking hole 111 which is communicating with the through hole 11. Next the support plate 1 is joined with another support plate 1 by the insertion segment 14 and the insertion hole 15 thereof inserted into and mounted with the insertion hole 15 and the insertion segment 14 of the another support plate 1 respectively. At the same time, the leaning and mounting portions 22 extending from the outer end of the locking portions 21 of the leaning pieces 2 are used for support the connected form of the support plates 1. Thereby the respective support plates 1 are connected and kept upright while a cross section of the connected support plates 1 is in a zig-zag form, a linear form, or a polygonal form. A pair of glasses 3 is held by a bridge portion 31 thereof placed on the positioning hook 231 of the extension portion 23 of the leaning piece 2 and two leg portions 32 of the glasses 3 are inserted into the two mounting holes 121 on a rear end of the connecting segments 12 at the respective two sides of the support plate 1 for positioning so as to display the glasses 3.

Figure 5:
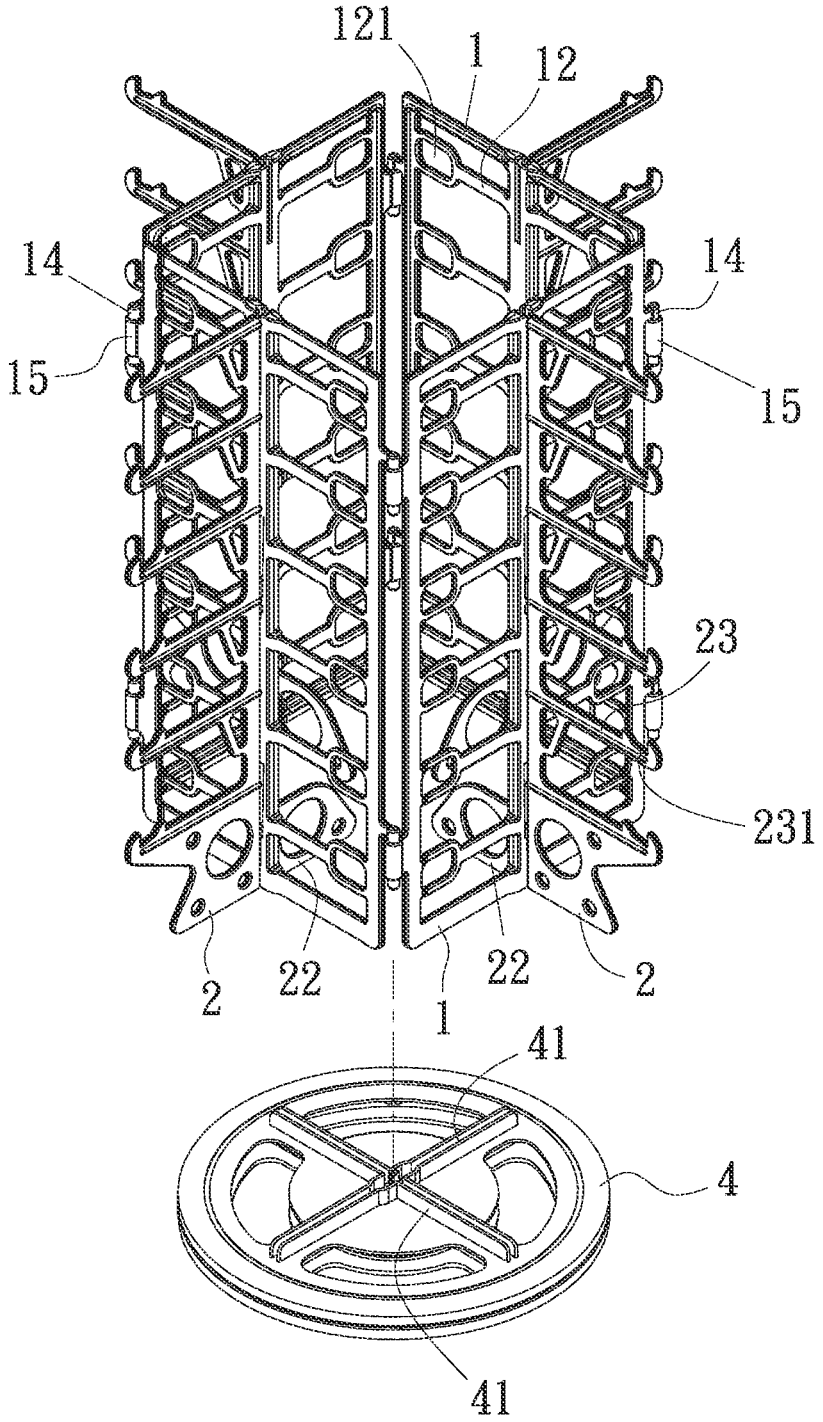
FIG. 5 is an exploded view of another embodiment according to the present invention.
Figure 6:
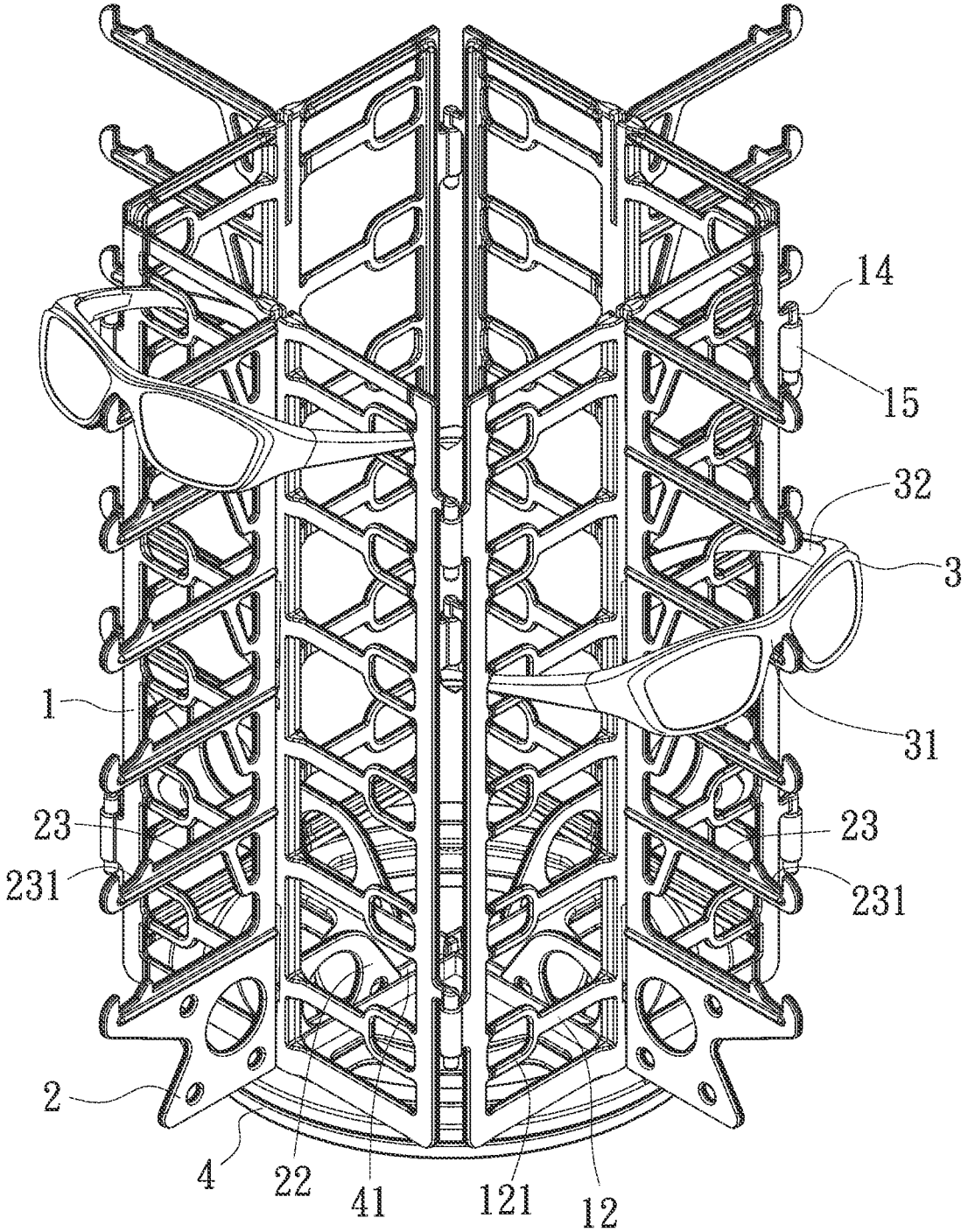
FIG. 6 is a perspective view of another embodiment in use according to the present invention.

Also refer to FIG. 5, the present glasses display stand further includes a base 4 which is provided with a plurality of mounting and fixing slots 41 each of which is corresponding to the leaning and mounting portion 22 extending from an outer end of the locking portion 21 of the leaning piece 2 at the lowest position. After the leaning piece 2 connected and fixed on the support plate 1, the respective support plates 1 are joined by the insertion segments 14 and the insertion holes 15 of one of the support plates 1 being mounted in and connected with the insertion holes 15 and the insertion segments 14 of the adjacent support plates 1 respectively and kept upright. Then the upright support plates 1 are disposed on the base 4 by the leaning and mounting portions 22 of the leaning pieces 2 being inserted and positioned in the mounting and fixing slots 41 of the base 4. Thereby the glasses 3 can be displayed (also refer to FIG. 6). By the base 4, the support plates 1 and the leaning pieces 2 arranged above the base 4 can be rotated so that consumers can select the glasses 3 they need more conveniently.

Figure 7:
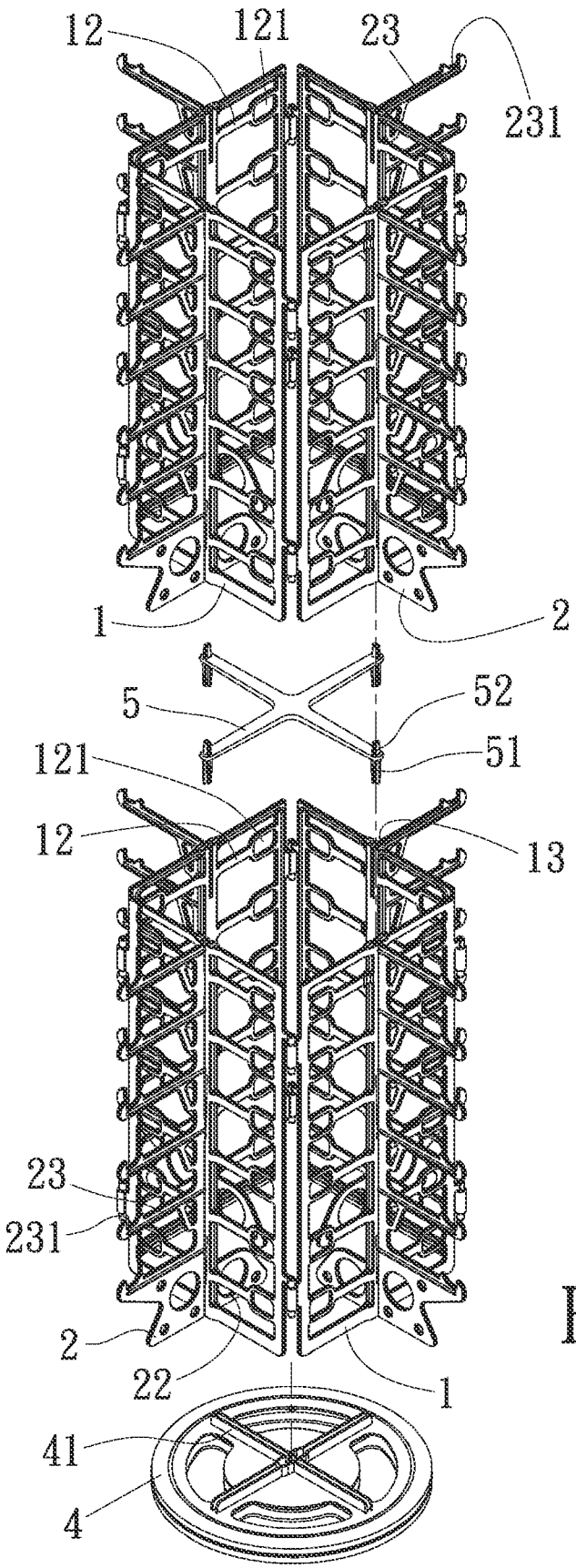
FIG. 7 is an exploded view of a further embodiment according to the present invention.

Moreover, refer to FIG. 7, a further embodiment is disclosed. The present glasses display stand further includes a connecting member 5 which includes a plurality of lower insertion portions 51 located on a bottom end thereof and a plurality of upper insertion portions 52 located on a top end thereof, which are corresponding to the insertion slots 13 on the top of the support plates 1 and the lower insertion portions 51 respectively. The lower insertion portions 51 are inserted and fixed in the insertion slots 13 on the top of the support plates 1 while the upper insertion portions 52 are plugged into and connected with a bottom of another square prism formed by other support plates 1. Thereby the present glasses display stand is formed by polygonal prisms of the support plates 1 connected and stacked in layers for displaying more glasses 3.

Figure 8:
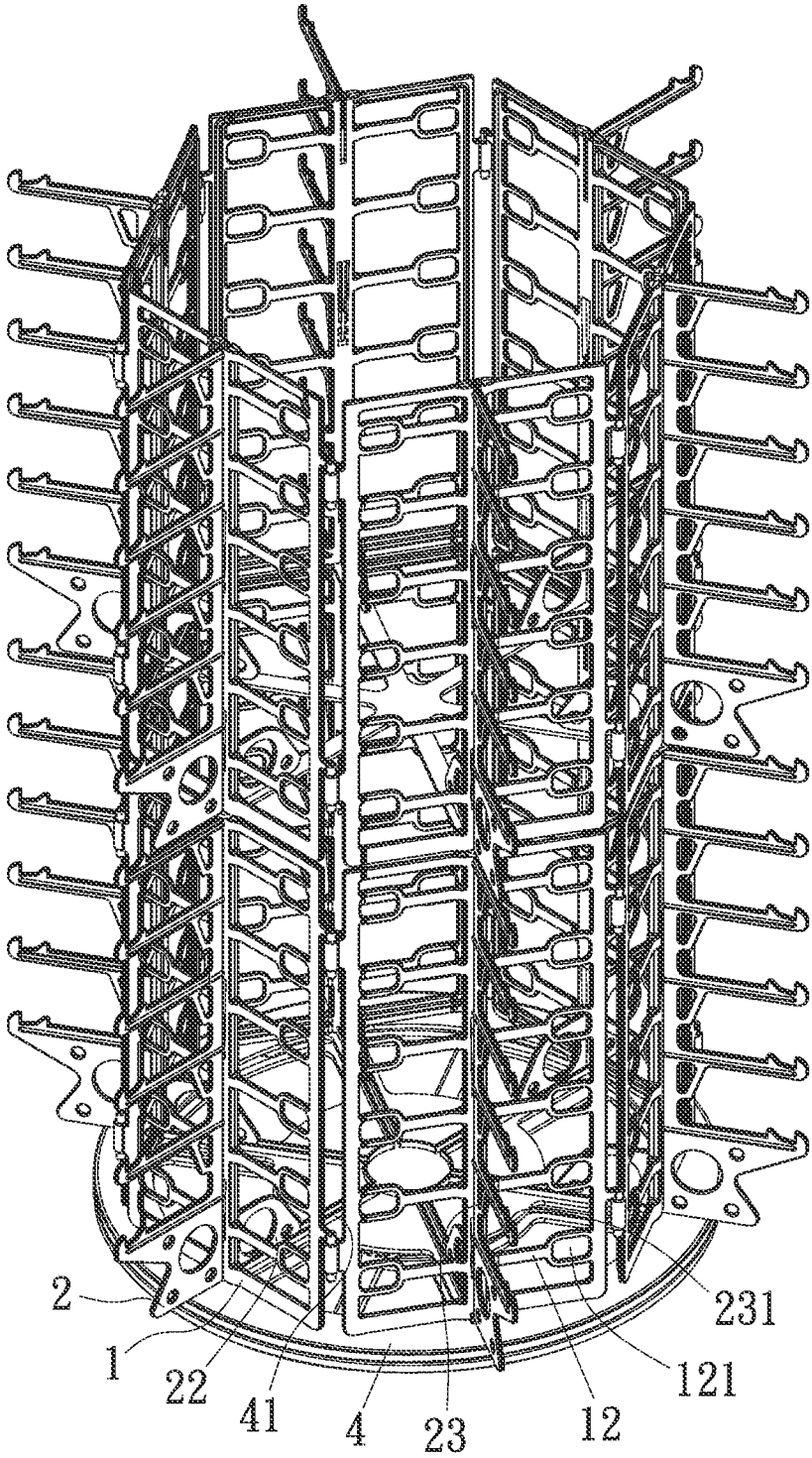
FIG. 8 is a perspective view of a further embodiment in use according to the present invention.

Furthermore, the support plates 1 are not only connected and by the insertion segments 14 and the insertion holes 15 on two sides thereof to form an upright square prism but also positioned by the leaning and mounting portions 22 of the leaning pieces 2 being inserted and mounted in the mounting and fixing slots 41 arranged in a crossed manner at the base 4. Also refer to FIG. 8, a further embodiment in use is revealed. The respective support plates 1 are connected by the insertion segments 14 and the insertion holes 15 on two sides thereof to form an upright polygonal prism which is positioned by the leaning and mounting portions 22 of the leaning pieces 2 being inserted and mounted in the mounting and fixing slots 41 arranged radially at the base 4. The support plates 1 can also be connected and stacked in layers by the connecting member 5.

In summary, compared with techniques available now, the present device can be assembly in different ways according to user's requirements to get different styles for the glasses display stand. Moreover, the assembly of the glasses display stand is fast and the glasses display stand is more convenient to use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A glasses display stand comprising:

a plurality of support plates; and a plurality of leaning pieces;

wherein each of the plurality of support plates includes at least one through hole located on a middle part thereof, a plurality of connecting segments arranged at each of two sides of each support plate in horizontal pairs, and at least one insertion segment and at least one insertion hole which are disposed in correspondence with each other and project from two sides of each support plate; wherein the through hole is provided with at least one locking hole communicating with a bottom of the through hole and each of the connecting segments is provided with a mounting hole located on an outer end thereof; wherein the insertion segment and the insertion hole are used for insertion and connection with other ones of the plurality of support plates;

wherein each of the plurality of leaning pieces is disposed in correspondence with a respective one of the plurality of support plates and has at least one locking portion corresponding to the through hole of the respective support plate and projecting from one end of the respective leaning piece, each of the plurality of leaning pieces includes a leaning and mounting portion extending from an outer end of the locking portion of the respective leaning piece at a first end of the respective leaning piece, and a plurality of extension portions which extend and project from a second end of the respective leaning piece opposite to the first end, the plurality of extension portions being disposed in correspondence to the respective pairs of the connecting segments of the respective support plate; wherein the locking portion is capable of being inserted through the through hole of the respective support plate and moved downward to be locked and positioned in the locking hole which is in communication with the through hole, and a positioning hook is formed on a distal end of each of the plurality of extension portions;

whereby at least one pair of glasses is supported on the glasses display stand by passing ear pieces of the at least one pair of gasses through selected mounting holes of each of a corresponding horizontal pair of the plurality of connecting segments and resting a bridge portion of the at least one pair of glasses on a respective positioning hook corresponding to the selected mounting holes.

2. The glasses display stand as claimed in claim 1, wherein an insertion slot in which a display board is inserted is formed on a top of the respective support plate.

3. The glasses display stand as claimed in claim 1, wherein each of the support plates are kept upright and a cross section thereof is in a form selected from the group consisting of a zig-zag form, a linear form, and a polygonal form after the support plates are connected.

4. The glasses display stand as claimed in claim 1, wherein the glasses display stand further includes a base which is provided with a plurality of mounting and fixing slots each of which corresponds to the leaning and mounting portion extending from an outer end of the locking portion of each of the plurality of leaning pieces at the first end thereof; after each of the plurality of leaning pieces are connected and fixed on one of the plurality of support plates, the plurality of support plates are disposed on the base and connected thereto by the leaning and mounting portions of the plurality of leaning pieces being respectively inserted and positioned in corresponding ones of the plurality of mounting and fixing slots of the base.

5. The glasses display stand as claimed in claim 4, wherein each of the plurality of support plates are connected to an adjacent other of the plurality of support plates by coupling of one of the at least one insertion segment or the at least one insertion hole thereof with a corresponding one of the at least one insertion hole or the at least one insertion segment of the adjacent other of the plurality of support plates respectively to form an upright square prism which is positioned by the leaning and mounting portions of the plurality of leaning pieces being inserted and mounted in the corresponding ones of the plurality of mounting and fixing slots arranged in a crossed manner at the base.

6. The glasses display stand as claimed in claim 5, wherein the glasses display stand further includes a connecting member which includes a plurality of lower insertion portions located on a bottom end thereof and a plurality of upper insertion portions located on a top end thereof, which correspond to insertion slots formed on a top of the plurality of support plates and the lower insertion portions respectively; the lower insertion portions are inserted and fixed in the insertion slots on the top of a portion of the plurality support plates and the upper insertion portions are plugged into and connected with a bottom of other ones of the plurality of support plates.

7. The glasses display stand as claimed in claim 4, wherein each of the plurality of support plates are connected to an adjacent other of the plurality of support plates by coupling of one of the at least one insertion segment or the at least one insertion hole thereof with a corresponding one of the at least one insertion hole or the at least one insertion segment of the adjacent other of the plurality of support plates respectively to form an upright polygonal prism which is positioned by the leaning and mounting portions of the plurality of leaning pieces being inserted and mounted in the corresponding ones of the plurality of mounting and fixing slots arranged radially at the base.

8. The glasses display stand as claimed in claim 7, wherein the glasses display stand further includes a connecting member which includes a plurality of lower insertion portions located on a bottom end thereof and a plurality of upper insertion portions located on a top end thereof, which correspond to insertion slots formed on a top of the plurality of support plates and the lower insertion portions respectively; the lower insertion portions are inserted and fixed in the insertion slots on the top of a portion of the plurality of support plates and the upper insertion portions are plugged into and connected with a bottom of other ones of the plurality of support plates.

9. The glasses display stand as claimed in claim 4, wherein the glasses display stand further includes a connecting member which includes a plurality of lower insertion portions located on a bottom end thereof and a plurality of upper insertion portions located on a top end thereof, which correspond to insertion slots formed on a top of the plurality of support plates and the lower insertion portions respectively; the lower insertion portions are inserted and fixed in the insertion slots on the top of a portion of the plurality of support plates and the upper insertion portions are plugged into and connected with a bottom of other ones of the plurality of support plates.

10. The glasses display stand as claimed in claim 1, wherein the glasses display stand further includes a connecting member which includes a plurality of lower insertion portions located on a bottom end thereof and a plurality of upper insertion portions located on a top end thereof, which correspond to insertion slots formed on a top of the plurality of support plates and the lower insertion portions respectively; the lower insertion portions are inserted and fixed in the insertion slots on the top of a portion of the plurality of support plates and the upper insertion portions are plugged into and connected with a bottom of other ones of the plurality of support plates.

* * * * *